United States Patent [19]

Harper

[11] Patent Number: 4,856,692

[45] Date of Patent: Aug. 15, 1989

[54] FEEDING APPARATUS

[75] Inventor: Christopher T. Harper, Eastleigh, United Kingdom

[73] Assignee: William R. Warner & Co. Limited, United Kingdom

[21] Appl. No.: 82,014

[22] Filed: Aug. 5, 1987

[30] Foreign Application Priority Data

Aug. 15, 1986 [GB] United Kingdom ..... 8619906
Dec. 11, 1986 [GB] United Kingdom ..... 862946

[51] Int. Cl.[4] ..... G65H 20/00; G65H 27/00
[52] U.S. Cl. ..... 226/119; 242/57
[58] Field of Search ..... 226/118, 119; 242/57, 242/75, 75.5, 75.51, 206

[56] References Cited

U.S. PATENT DOCUMENTS

| | | | |
|---|---|---|---|
| 3,669,375 | 6/1972 | Bruton | 242/55.01 X |
| 3,826,442 | 7/1974 | Bethke | 242/75.5 |
| 3,975,063 | 8/1976 | Mahotka et al. | 384/18 |
| 4,204,180 | 5/1980 | Usui et al. | 242/57 X |
| 4,526,638 | 7/1985 | Clements | 156/159 |

*Primary Examiner*—David Werner
*Attorney, Agent, or Firm*—Daniel A. Scola, Jr.; Howard Olevsky

[57] ABSTRACT

A feeding apparatus for feeding a material from a material supply to a further apparatus, particularly a packaging apparatus. The apparatus comprises a storage buffer for storing an amount of the material, a first feed arrangement for feeding the material from the material supply to the storage buffer, and a second feed arrangement for feeding the material from the storage buffer to the further apparatus. The storage buffer comprises a plurality of movable rollers and a plurality of fixed rollers disposed above the movable rollers. The material is wound alternately between the fixed and movable rollers. The movable rollers are movable toward the fixed rollers by the tension in the material, and are movable away from the fixed rollers under the influence of gravity. This enables the material to be fed continuously to the further apparatus during an interruption of the material supply. The storage buffer further comprises a carriage to which the movable rollers are mounted, the carriage being movable with the movable rollers. A guide arrangement is provided for guiding movement of the carriage, and the guide arrangement is adapted to maintain said carriage in a substantially constant orientation during movement toward and away from the fixed rollers. This serves to maintain a substantially uniform tension in the material in the storage buffer.

3 Claims, 3 Drawing Sheets

FEEDING APPARATUS

BACKGROUND OF THE INVENTION

1. Field of the Invention

This invention relates to a feeding apparatus. More specifically, the invention relates to a feeding apparatus for feeding a material from a material supply to a further apparatus, particularly to a packaging apparatus.

2. Description of the Prior Art

Packaging apparatus is usually fed from a supply of packaging material, which supply comprises a core upon which the material is wound. Usually the material is in the form of a sheet.

Problems can arise when the material supply is exhausted. When this happens it is necessary to stop feeding the material to the packaging apparatus while the material supply is replenished. This procedure is inefficient because it causes the operation of the packaging apparatus to be interrupted at least for the time it takes to replenish the material supply.

The problem is even more acute with certain types of packaging apparatus, such as packaging apparatus for producing blister packs. In this apparatus the blisters are formed in the material by the application of heat and the amount of heat delivered to the material is carefully controlled. When the material supply is interrupted the material in the packaging apparatus stops moving and becomes overheated, which causes distortion of the material. It may take up to 20 minutes to re-synchronise the apparatus after the feed of the material has been restarted.

One way to solve this problem is to provide a feeding apparatus for the packaging apparatus which includes a storage buffer for the material. This enables the material to be fed to the packaging apparatus from the buffer when the material supply is changed.

A typical storage buffer is shown in U.K. Patent No. 1244066, owned by Industrie-Companie Kleinweffers Plasticmachinen GMbH & Co. K.G. In this specification the storage buffer comprises a plurality of fixed rollers disposed below a plurality of movable rollers. The sheet material is wound alternately between the fixed and movable rollers. The buffer has a sheet material inlet and a sheet material outlet.

When there is an interruption in the feed of material to the inlet, material can still be drawn from the outlet by moving the movable rollers towards the fixed rollers.

The movable rollers are mounted to a carriage which is driven towards and away from the fixed rollers by a hydraulic ram.

Another example of a storage buffer is shown in U.K. Patent Application early publication No. 2168038A, applied for by Harris Graphics Corporation.

In this specification the fixed rollers are arranged at the same level as the movable rollers, and the movable rollers are movable horizontally towards and away from the fixed rollers. The movable rollers are mounted to a carriage which is, movable by means of a drive motor.

In U.K. Patent Application early publication No. 2156319A, applied for by Focke & Co, a further example of storage buffer is shown. In this specification the movable rollers are movable in an arcuate path by a drive motor. This, arcuate path can lead to additional problems in controlling the tension in the material.

The movable rollers are mounted to a carriage in the form of a roller arm. The roller arm is provided with a toothed segment which engages a pinion on the drive motor thereby causing pivotal movement in the roller arm so that the movable rollers move towards the fixed rollers.

In all three of the above specifications careful control is required of the movement of the movable rollers by the hydraulic ram or by the drive motor. In particular it is necessary to synchronise the rate at which the movable rollers are moved with the rate at which material is required by the further apparatus.

In practice, complicated control arrangements are needed to achieve this.

The need for this synchronisation would not be necessary if the drive motor could be dispensed with. However, in all the above specifications, the motor could not be dispensed with because otherwise there would be no way to move the rollers away from one another.

If the fixed rollers are arranged above the movable rollers then it would theoretically be possible for the movable rollers to be drawn toward the feed rollers by the tension in the material. The movable rollers could then move away from the fixed rollers by gravity alone.

However, this arrangement is not found to be practicable because it causes non-uniform tensioning of the sheet material in the storage means. This can upset the uniform feed to the further apparatus and can even cause the material to stretch or break.

Other apparatus is described in U.K. Patent Nos. 1402079 and 1554696, European Patent No. 37752, U.K. Patent Application early publication Nos. 2142609A and 2056953A, and European Patent Application early publication No. 139088A.

SUMMARY OF THE INVENTION

It is an object of the present invention to provide an improved packaging apparatus.

It is another object of the invention to provide a feeding apparatus having movable and fixed rollers in which the movable rollers are moved by tension in the material being fed, rather than by a drive motor.

It is a further object of the invention to provide a feeding apparatus having a storage means in which the material being fed through the storage means can be maintained at a substantially uniform tension.

It is a further object of the invention to provide a feeding apparatus which is of a less complicated construction than has heretofore been possible.

It is a further object of the invention to provide a feeding apparatus in which the rate at which material is fed to a further apparatus can be controlled in accordance with the tension of the material.

According to the present invention there is provided a feeding apparatus for feeding a material from a material supply to a further apparatus, said apparatus comprising storage means for storing an amount of said material, preferably first feed means for feeding said material from the material supply to the storage means, and preferably second feed means for feeding said material from the storage means to the further apparatus, wherein said storage means comprises: a plurality of movable rollers; a plurality of fixed rollers preferably disposed above the movable rollers, the material preferably being wound alternately between the fixed and movable rollers, and said movable rollers preferably being movable toward the fixed rollers by the tension in the material, and preferably being movable away from the fixed rollers under the influence of gravity, whereby said material can be fed continuously to the packaging apparatus during an interruption of the material supply; a carriage to which the movable rollers are mounted, said carriage being movable with the movable rollers; and guide means to guiding movement of said carriage, said guide means being adapted to maintain said carriage in a substantially constant orientation during movement toward and away from the fixed rollers.

This arrangement enables the feed of material to the apparatus to be continued after the material supply is exhausted. Thus, the material supply can be replenished without having to interrupt the supply of the material to the apparatus.

Moreover, the guide means serves to maintain a uniform tension in the material, so that it is not necessary to provide a drive motor to drive the movable rollers.

It is possible for the guide means to take any configuration which maintains the orientation of the carriage substantially constant during movement. This is necessary to prevent one end of the carriage from tilting during movement, because this has been found to create non-uniform tension in the material.

Advantageously the guide means comprises a rack and pinion arrangement.

Preferably the apparatus further comprises a frame to which the guide means and/or the fixed rollers are mounted.

In a preferred construction the rack is provided on the frame and the pinion is provided on the carriage.

It is desirable that four of said racks are provided and four of said pinions are provided each at opposite corners of the frame.

The second feed means may include a first drive means for driving the feed of the material to the further apparatus.

Preferably the second feed means further includes a second drive means for driving the feed of the material to the further apparatus, the second drive means being actuable in response to detections means which detects tension in the sheet material. The second drive means can be used to provide an additional feed in situations when the torque from the first drive means is not great enough.

The second drive means can be operatively connected to the detection means in such a manner that the second drive means is actuated when the tension in the material falls below a predetermined level.

In this way the second drive means can also be used to control the tension in the material fed to the further apparatus.

The detection means preferably comprises a "dancing roller". This is a roller arranged in a slot and movable up and down the slot. The material is arranged underneath the roller so that when it becomes more tensioned it lifts the roller. When the roller is lifted to a preselected point (which is indicative of a particular tension in the material) the roller engages a switch which deactivates the second drive means. When the roller moves out of engagement with the switch the second drive means is activated.

The material is preferably a sheet material and may be, for example, plastics or aluminum.

The present invention is particularly useful for thin sheet material such as a film or foil. Typically the thickness of the material would be less than 2 mm.

Preferably at least same of the rollers are removable whereby the number of rollers can be selectively increased or decreased. This enables the capacity of the storage means to be increased or decreased.

The first feed means may include material clamping means for clamping the material to the feeding device at a position between the storage means and the material supply. When the material clamping means is actuated, no further material can be drawn into the storage means, so that the movable rollers are drawn towards the fixed rollers by the tension in the material.

When the sheet material clamping means is deactivated the material can again be drawn into the storage means, so that movable rollers move back to the first position under the influence of gravity. Movable roller clamping means can be provided for clamping the movable rollers on the first position; this ensures that the movable rollers are not drawn towards the fixed rollers, except when the material clamping means is activated.

The first feed means may also include first detection means for detecting when a predetermined quantity of material remains in the material supply. The first detection means may be adapted to generate a signal to activate a warning device when the predetermined quantity of material remains on the material supply.

The first feed means may further include second detection means for detecting a trailing edge of the material. The second detection means is adapted to generate a signal which activates the material clamping means.

Support means can be provided, which is adapted to support the material supply. Preferably the support means has two positions at which the material supply can be supported, so that two separate supplies of material can be supported simultaneously.

According to another aspect of the invention there is provided a feeding apparatus for feeding a material from a material supply to a further apparatus, said feeding apparatus comprising storage means for storing an amount of said material, first feed means for feeding said material from the material supply to the storage means and second feed means for feeding said material from the first feed means to the further apparatus, wherein said storage means comprises:

a plurality of fixed rollers and a plurality of movable rollers, the material being wound alternately between the fixed and movable rollers, and said movable rollers being movable toward and away from said fixed rollers, whereby said material can be fed continuously to the further apparatus during an interruption of the material supply;

and wherein said second feed means comprises:

first and second drive means for driving the feed of material to the further apparatus; and detection means adapted to detect the tension of the material, the second drive means being actuatable in response to the tension detected by the detection means.

The feeding apparatus according to this aspect of the invention may be provided with any combination of the features of the feeding apparatus according to the first aspect of the invention.

The feeding apparatus is especially useful for feeding sheet material to packaging apparatus, particularly packaging apparatus for blister packs and for applying labels to articles such as bottles or other containers.

The packaging apparatus may be supplied with sheet material from two or more feeding apparatus simultaneously.

BRIEF DESCRIPTION OF THE DRAWINGS

Reference is now made to the accompanying drawings in which.

DESCRIPTION OF THE PREFERRED EMBODIMENTS

Figure 1:
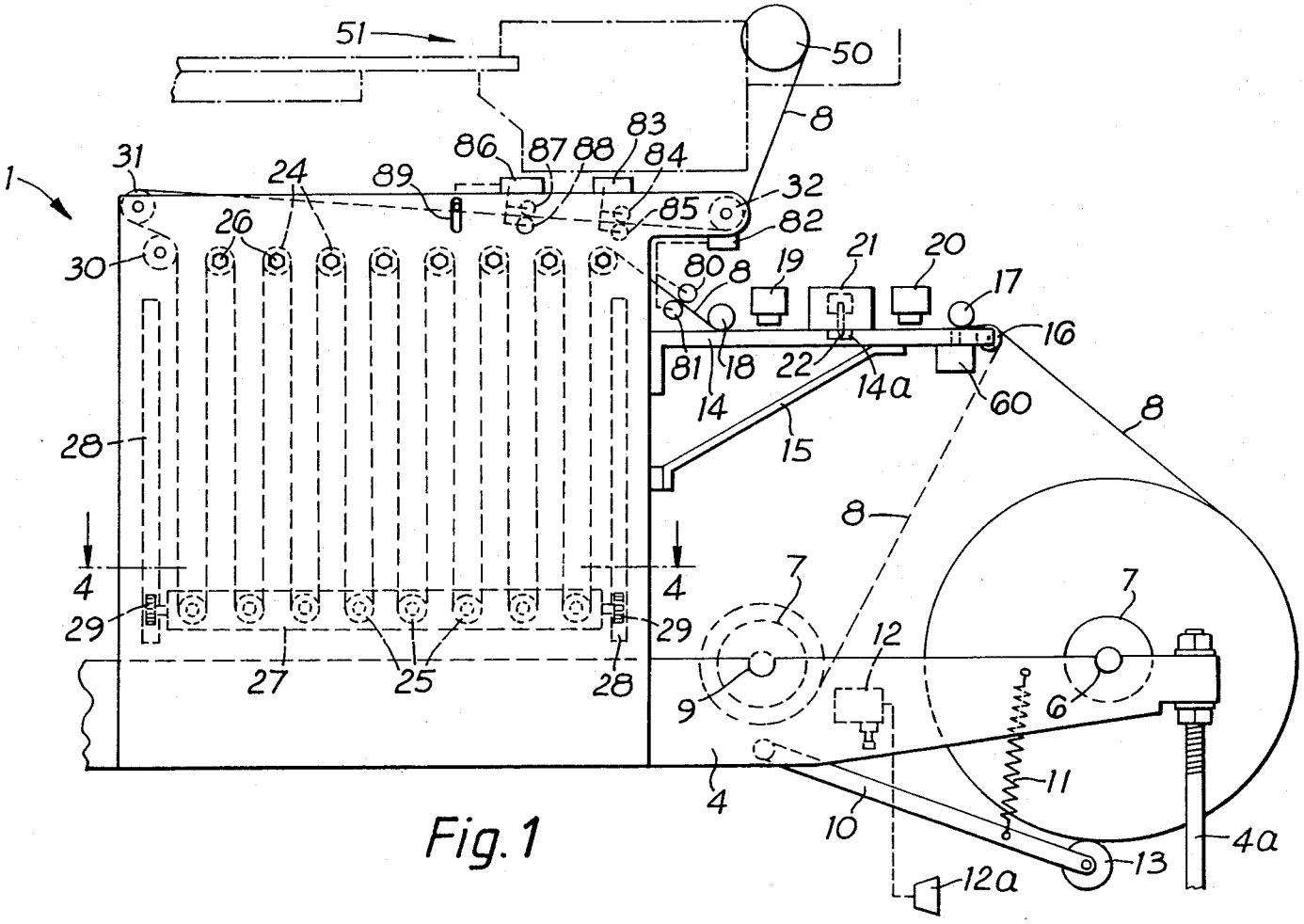
FIG. 1 is a schematic side elevation of a feeding apparatus according to the invention.

Referring to the drawings a feeding apparatus generally designated 1 comprises a frame 1*a* including two side plates 2 and 3, mounted to support means in the form of base plates 4 and 5. The base plates 4 and 5 are provided with support legs 4*a* add 5*a* respectively.

A first slot 6 is provided in the base plates 4 and 5 to enable a material supply in the form of a reel 7 of sheet material 8 to be mounted to the base plates 4 and 5 in a first position.

A second slot 9 is provided in the base plates 4 and 5 between the slot 6 and the side plates 2 and 3. The second slot 9 is of the same size and shape as the first slot 6.

The feeding apparatus includes first feed means for feeding the material 8 from the reel 7 to the storage means 23. The first feed means includes nip rollers 80 and 81 which are driven by a first feed motor 82. The rollers 80 and 81, together with the motor 82, feed the material 8 to the storage means 23.

The first feed means further includes first detection means to detect when a predetermined length of sheet material 8 remains on the reel 7. The first detection means can be calibrated to be actuated a selected period (for example five minutes) before the sheet material 8 is exhausted on the reel 7.

The first detection means comprises a detector arm 10, biasing means in the form of a spring 11 and a switch 12; the switch 12 can be a microswitch. The detector arm 10 is provided with a roller 13 which engages the sheet material 8 on the reel 7. The switch 12 may be adjustable in position so that the selected period can be adjusted The spring 11 urges the roller 13 against the sheet material 8 so that when the predetermined length of material 8 remains on the reel 7 the switch 12 is actuated; the actuation of the switch 12 causes a warning siren 12*a* to be activated. At this point the reel 7 can be moved from the first slot 6 to the second slot 9; in FIG. 1 the reel 7 is shown in the first slot 6 in full lines and in the second slot 9 in dashed lines. After the reel 7 has been moved to the second slot 9 a fresh reel can be mounted to the first slot 6.

The movement of the depleted reel 7 to the second slot 9 enables the length that the base plates 4 and 5 extend from the frame 1*a* to be reduced.

A cutting table 14 is secured to the side plates 2 and 3 and is, supported by support arms 15. Guide rollers 16, 17 and 18 for the sheet material 8 are provided on the cutting table 14. The rollers 80 and 81 may also be secured to the table 14.

Sheet material clamping means in the form of a first clamp 19 and a second clamp 20 are disposed on the table 14 between the guide rollers 17 and 18. A cutting device 21 having a cutting knife 22 is disposed on the table 14 between the clamps 19 and 20. The cutting knife 22 is movable in a groove 14*a* of the table 14 in a direction substantially parallel to the groove 14*a;* this direction is indicated by arrow A in FIG. 2.

Second detection means in the form of a detector 60, such as photocell, is arranged before the clamp 20, for detecting the trailing edge of the sheet material 8.

The sheet material 8 is fed from the roller 18 to the storage means 23. The sheet material 8 is fed from the storage means 23 to second feed means which includes guide rollers 30, 31 and 32. The second feed means serves to feed the material 8 from the storage means 23 to a guide roller 50 of a packaging apparatus 51.

The second feed means further includes first drive means in the form of a first feed motor 83 which drives nip rollers 84 and 85, and second drive means in the form of a second feed motor 86 which drives nip rollers 87 and 88.

The second feed motor 86 is activated when the torque supplied by the first feed motor 83 is not great enough. A detector 89 is provided to actuate the second feed motor 86 when the tension in the sheet material falls below a predetermined level.

Figure 5:
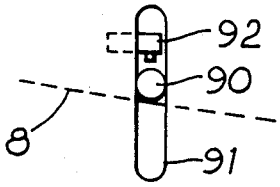
FIG. 5 is a schematic view of a dancing roller arrangement for use with the feeding apparatus according to the invention.

The detector 89 is shown in greater detail in FIG. 5 and comprises a roller 90 disposed in a slot 91 in the plates 2 and 3. The roller 90 is arranged above and supported by the material 8.

When the tension in the material 8 falls the material 8 becomes slacker which causes the roller 90 to move downwardly in the slot 91. This causes the roller 90 to move out of engagement with a switch 92 thereby actuating the switch 92; this actuates the second feed motor 86. As the tension in the material 8 rises, the roller 90 moves upwardly back into engagement with the switch 92, thereby deactivating the switch 92 and the second feed motor 86. As long as the roller 90 is held in engagement with the switch 92 the second feed motor 86 remains inactive.

It will be appreciated that other arrangements of the switch 92 and the roller 90 are possible.

Figure 2:
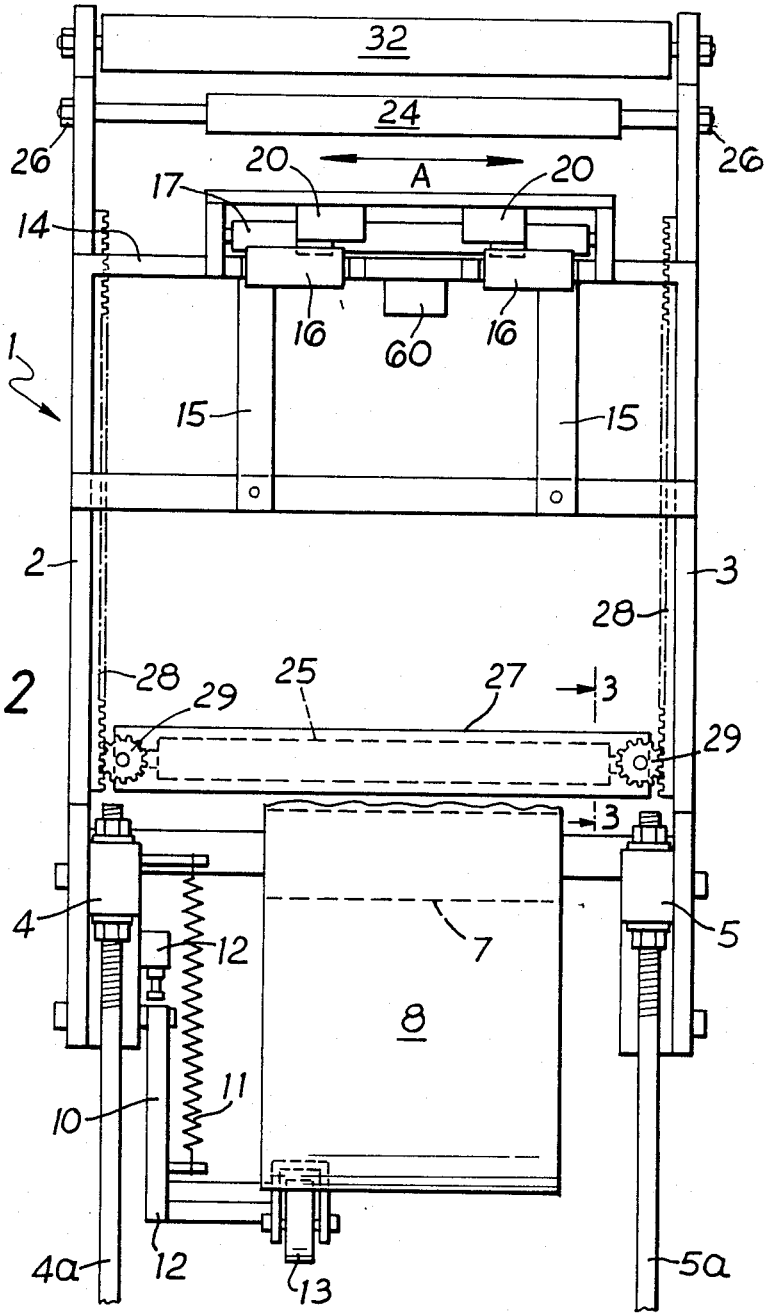
FIG. 2 is a schematic end elevation of the feeding apparatus according to the invention.
Figure 3:
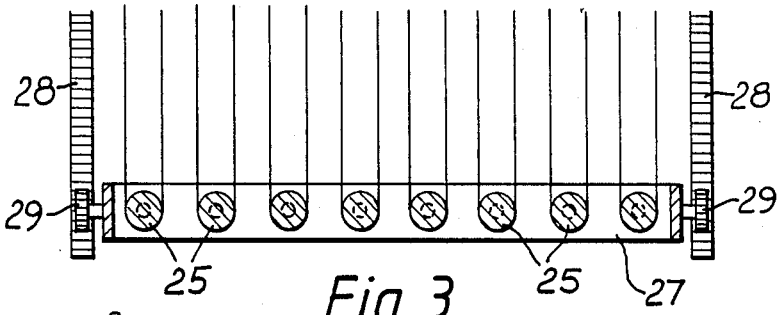
FIG. 3 is a view on lines 3—3 of FIG. 2.

For clarity the detector 89 is not shown in FIG. 2.

The storage means 23 includes a plurality of fixed rollers 24 and a plurality of movable rollers 25. The fixed rollers 24 ar fixed to the side plates 2 and 3 by nuts 26, while the movable rollers 25 are mounted to a carriage 27. At least some of the rollers 24 and 25 may be removable.

The carriage 27 comprises opposite plates 93 and 94 which are connected by plates 95 and 96. The movable rollers 25 are fixed to the plates 93 and 94.

The carriage 27 is mounted to the side plates 2 and 3 by guide means in the form of four racks 28 and four pinions 29. The racks 28 are disposed vertically on the plates 2 and 3, whilst the pinions 29 are arranged on the plates 95 and 96 of the carriage 27, in engagement with the racks 29.

The racks 28 and the pinions 29 serve to maintain the carriage 27 in a substantially constant orientation at all times. Thus, it is not possible for one end of the carriage to lift relative to the other end during movement of the carriage.

The movable rollers 25 are movable between a first position (shown in the drawings), in which their distance from the fixed rollers 24 is a maximum, and a second position (not shown), in which their distance from the fixed rollers 24 is a minimum.

Figure 4:
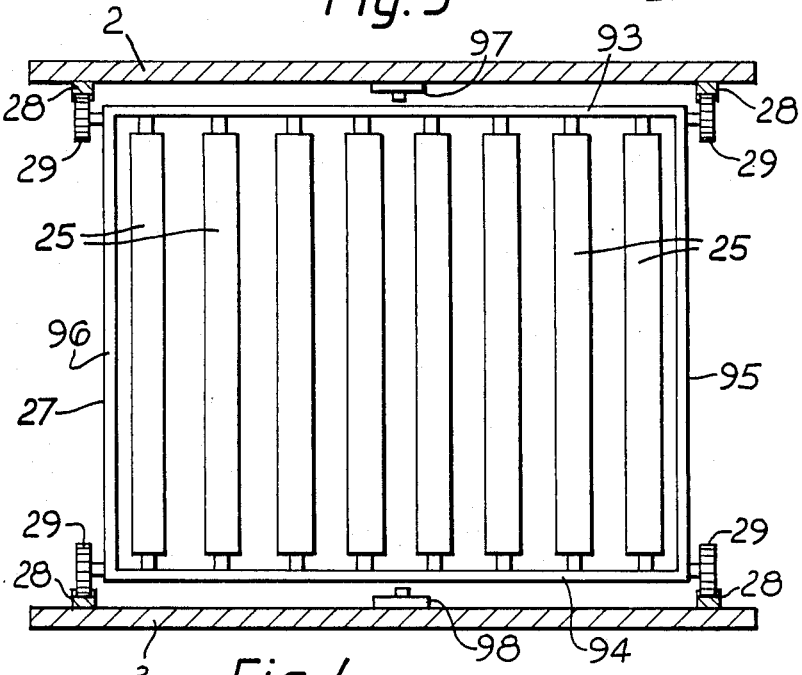
FIG. 4 is a view on lines 4—4 of FIG. 1.

Movable roller clamping means, in the form of clamps 97 and 98 (see FIG. 4), is provided for clamping the movable rollers 25 in the first position.

The operation of the feeding apparatus 1 is as follows. The drive motor 82 draws the sheet material 8 from the reel 7 which rotates as sheet material 8 is drawn from it. In the normal operating conditions the clamps 97 and 98 clamp the movable rollers 25 in the first position. The sheet material 8 is fed from the reel 7 to the roller 16, the clamp 20, the cutting device 21, the clamp 19 and the roller 18.

The sheet material 8 is then fed to the first of the fixed rollers 24 and then to the first of the movable rollers 25. The sheet material 8 "zig-zags" between the fixed rollers 24 and the movable rollers 25 to the roller 30. The sheet material 8 is fed from the roller 30 to the roller 31, and from the roller 31 to the roller 32. The feed motors 83 and 86 drive the feed of the material 8 to the roller 50 of the packaging apparatus 52.

When a predetermined length of sheet material 8 remains on the reel 7 the warning siren **12*a* is activated by a switch 12. At this time the reel 7 can be moved to the second slot 9 and a fresh reel can be placed in the first slot 6**.

After the trailing edge of the sheet material 8 is detected by the second detector 60, the first clamp 19 is actuated by a signal from the detector 60 to clamp the sheet material 8 to the table 14. The clamp 19 is actuated before the trailing edge of the sheet material passes under the cutting knife 22 of the cutting device 21. Simultaneously the clamps 97 and 98 are deactivated by a signal from the detector 60, so that the carriage 27 can move relative to the fixed rollers 24.

After the clamp 19 is actuated the drive motors 83 and 86 continue to draw the sheet material 8 from the storage means 23. The tension generated in the sheet material 8 causes the carriage 27, together with the movable rollers 25, to be drawn upwardly towards the second position. In this way the sheet material 8 stored in the storage means 23 is withdrawn therefrom.

While the sheet material 8 is being withdrawn from the storage means 23, sheet material from the fresh reel is fed under the second clamp 20 and under the cutting device 21. The second clamp 20 is then actuated by the operator to hold the fresh sheet material in position. The cutting device is then actuated by the operator to cut through the sheet material 8 and the fresh sheet material, which both lie under the cutting device 21. The adjoining cut edges of the sheet material 8 and the fresh sheet material can be joined together with, for example, adhesive tape.

The first and second clamps 19 and 20 can then be deactivated by the operator so that sheet material can be drawn from the fresh reel. When this happens the carriage 27 moves downwardly towards. The second position under the influence of gravity. During this period the fresh sheet material is accumulated in the storage means 23; also the rate at which the motor 82 draws the fresh material may be temporarily increased to facilitate filling of the storage means. When the movable rollers 25 reach the first position the clamps 97 and 98 are actuated to hold the movable rollers 25 in the second position.

It is during the movement of the carriage 27 and the movable rollers 25 towards the fixed rollers that the second feed motor 86 is most useful, because at this time extra torque is required to lift the weight of the carriage 27 and the movable rollers 25.

At all times the guide means maintains the carriage 27 in a substantially horizontal orientation so that it does not tilt. This maintains a uniform tension in the material 8 in the storage means thereby reducing the risk that the material will stretch or tear.

It will be appreciated that the feeding apparatus 1 does not require the use of a drive motor which operates directly on the movable rollers 25 or the carriage 27. Thus, there are no problems in synchronising the speed of such a motor with the rate at which material is required by the packaging apparatus 50.

It is not essential for the first and second feed means to be provided with drive means to drive the feed of material.

Thus, in an alternative embodiment is it possible to dispense with the feed motor 82 so that the first feed means does not actually drive the feed of material 8 to the storage means 23. In this case, the material 8 is drawn into the storage means 23 by the motors 83 and 86.

In a further embodiment the feed motors 83 and 86 can be dispensed with so that the second feed means does not drive the feed of material to the packaging apparatus. In this embodiment, the material 8 may be drawn through the feeding apparatus 1 by a motor provided on the packaging apparatus 50.

It will be appreciated that further modifications can be made within the scope of the appended claims.

I claim:

1. A feeding apparatus for feeding a material from a material supply to a further apparatus, said feeding apparatus comprising storage means for storing an amount of said material, and feed means for feeding said material from the material supply to the storage means and thence to the further apparatus, wherein said storage means comprises:

a substantially rectangular-shaped frame;

a plurality of movable rollers;

a plurality of fixed rollers mounted on the frame and disposed above the movable rollers, the material being wound alternately between the fixed and movable rollers, and said movable rollers being movable toward the fixed rollers by the tension in the material, and being movable away from the fixed rollers under the influence of gravity, whereby said material can be fed continuously to the further apparatus during an interruption of the material supply;

a substantially rectangular-shaped carriage to which the movable rollers are mounted, said carriage being movable with the movable rollers; and guide means for guiding movement of said carriage, said guide means comprising interengaged toothed rack and pinion means at each corner of the carriage with a rack mounted on the frame and a respective pinion mounted on the carriage for each of the rack and pinion means for maintaining said carriage in a substantially constant orientation during movement toward and away from the fixed rollers.

2. Feeding apparatus according to claim 1, wherein:

holding means is operatively associated with said movable rollers to prevent their movement toward the fixed rollers while a predetermined quantity of said material is present at said material supply; and means to detect exhaustion of said material below said predetermined quantity at said material supply and to release said holding means and enable movement of said movable rollers toward the fixed rollers.

3. Feeding apparatus according to claim 2, wherein: said movable rollers are carried on the carriage and have a first position spaced a maximum distance from the fixed rollers, and a second position spaced a minimum distance from the fixed rollers; and said holding means comprises clamping means which clamp said carriage at the first position thereof to prevent its movement toward the second position until said material is exhausted to said predetermined quantity.

* * * * *